United States Patent [19]

Dalman

[11] Patent Number: 4,575,700

[45] Date of Patent: Mar. 11, 1986

[54] PARALLEL PLATE TRANSMISSION LINES INTEGRATED WITH COPLANAR WAVEGUIDES OR SLOT LINES AND METHOD OF MAKING SAME

[75] Inventor: G. Conrad Dalman, Ithaca, N.Y.

[73] Assignee: Cornell Research Foundation, Inc., Ithaca, N.Y.

[21] Appl. No.: 611,295

[22] Filed: May 17, 1984

[51] Int. Cl.[4] ..... H01P 3/08

[52] U.S. Cl. ..... 333/238; 333/247; 357/4; 29/600

[58] Field of Search ..... 333/238, 246, 247; 357/4

[56] References Cited

U.S. PATENT DOCUMENTS

| | | | |
|---|---|---|---|
| 3,891,949 | 6/1975 | Marquardt et al. | 333/238 |
| 3,982,271 | 9/1976 | Olivieri et al. | 333/238 X |
| 4,379,307 | 4/1983 | Soclof | 333/238 X |

*Primary Examiner*—Paul Gensler

*Attorney, Agent, or Firm*—Sughrue, Mion, Zinn, Macpeak & Seas

[57] ABSTRACT

A solid state integrated circuit type transmission line structure is formed by a semi-conductor substrate consisting of an active layer and a semi insulating layer of given conductivities and permittivity which bears a groove extending through the active layer into the semi insulating layer of the substrate. A thin metalization coating on the active layer surface of the substrate extends into the slot along opposite slot sides thereof, and a low loss dielectric material of different permittivity at least partially fills the slot and extends between the metalization coatings of the slot. There is thus formed a slot line structure and parallel plate transmission line. Vapor or sputter deposited metal particles obliquely impinge on the surface of the substrate bearing the groove in two stages via opposite inclinations to insure metalization deposit along both sidewalls of the slot integrated to the flat upper surface coating prior to filling of the slots and covering of the metalized surface with the loss dielectric material.

6 Claims, 6 Drawing Figures

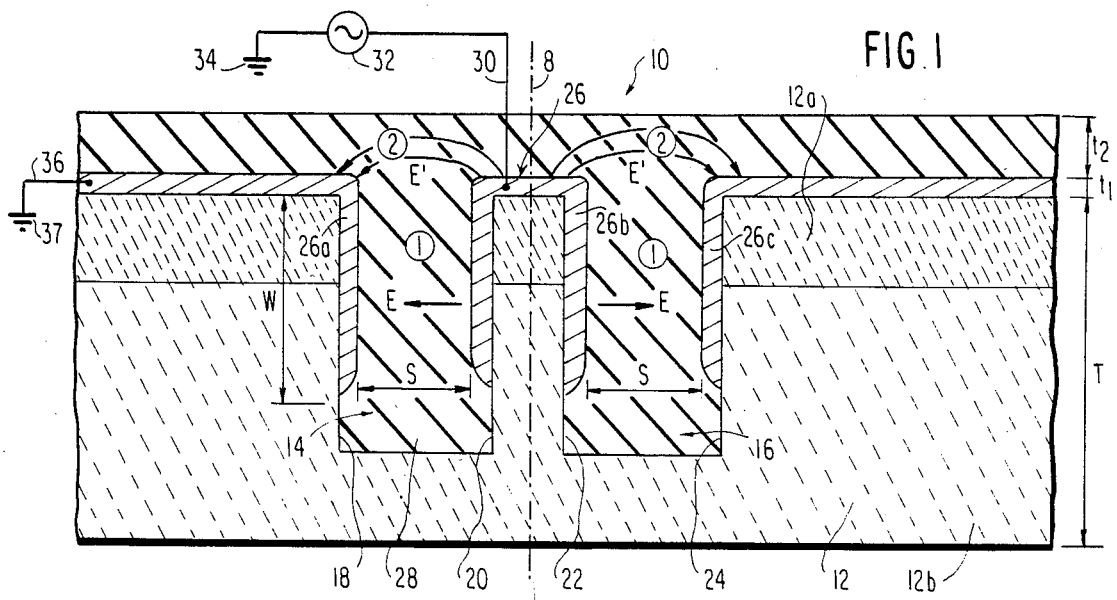
FIG. 1
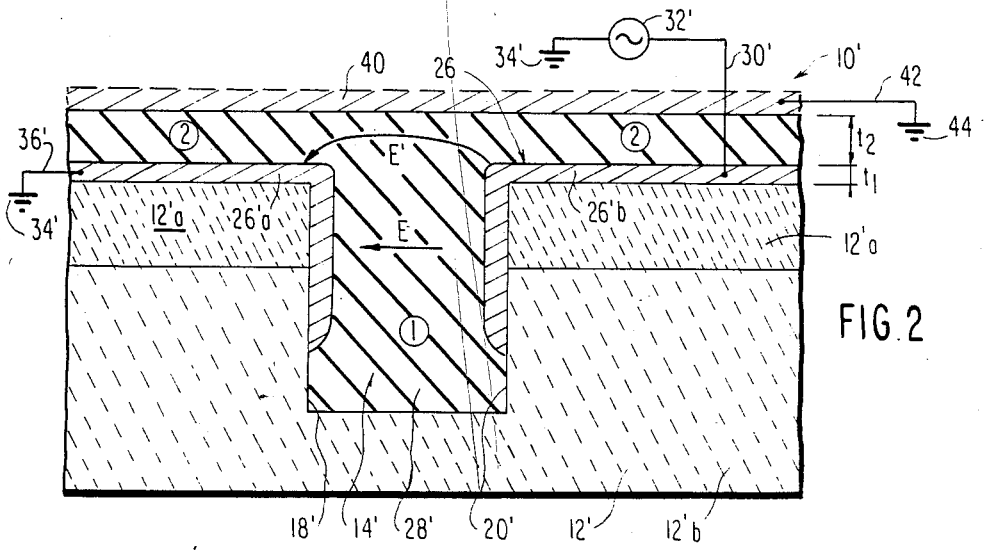
FIG. 2
FIG. 3a
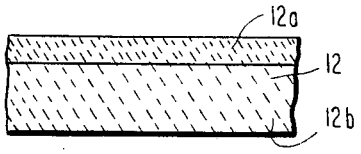
FIG. 3c
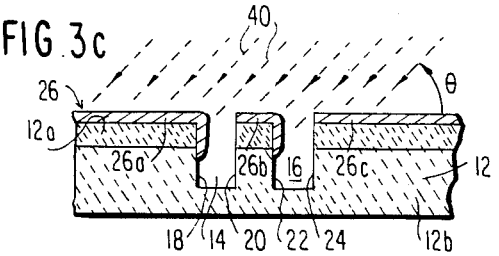
FIG. 3b
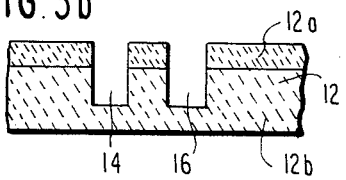
FIG. 3d
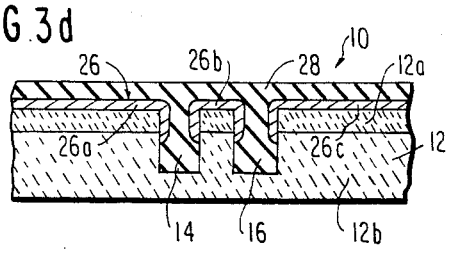

PARALLEL PLATE TRANSMISSION LINES INTEGRATED WITH COPLANAR WAVEGUIDES OR SLOT LINES AND METHOD OF MAKING SAME

FIELD OF THE INVENTION

This invention relates to transmission line structures, and more particularly to the fabrication of very small, low loss transmission lines that can be easily incorporated as a solid state integrated circuit element.

BACKGROUND OF THE INVENTION

Solid state elements have been fabricated by creating via chemical etching or ion milling, grooves or slots within a semi-conductor substrate material such as silicon. Further, by vapor deposition or sputtering thin metalization coatings may be subsequently deposited on the substrate. Such techniques normally involve the use of a mask to create distinctive patterns compatible to the solid state geometry of the integrated circuit device.

It is, therefore, a primary objection of the present invention to provide a novel combined parallel plate and coplanar, or slot-line transmission line structure which can be incorporated easily as a solid state circuit element and which is easily and simply fabricated and which has particularly desirable transmission line characteristics.

SUMMARY OF THE INVENTION

The present invention is partially directed to a solid state circuit type transmission line structure comprising a semi-conductor substrate of a given conductivity and permittivity. The substrate is provided with at least one slot. A thin metalization coating is applied onto the top surface of the substrate with the metalization coating extending into the slot along opposed slot sides thereof. A low loss dielectric material of a second given permittivity at least partially fills the slot and spans between the metal coatings on the slot sidewalls to define, with the top surface metalization, a slot line structure integrated to a parallel plate transmission line. Multiple slots may be provided within the substrate to define multiple segments of a combined parallel plate and coplanar waveguide transmission line structure.

A second aspect of the invention lies in the method of simplified fabrication of the combined parallel plate and slot-line transmission line structure. it comprises the steps of:

etching or ion milling at least one groove within one surface of the substrate to the depth of approximately one to five times the width of the groove; evaporating or sputtering a thin metal coating onto the surface of the semi-conductor substrate inclined to the plate of said substrate surface to cause metalization along one side of the at least one slot to a given depth within the slot integrated to that metal coating said second surface;

effecting continued vaporization or sputter deposition of said thin metal coating obliquely onto said surface at an opposite inclination to that of the previous application to insure metal deposition on the opposite side of the at least one slot and integrated to the metalization on the surface of the substrate; and applying a low loss dielectric material of different permittivity to the metalized substrate to at least partially fill said at least one slot so as to span between the metalizing coatings on opposite sides of the slot;

BRIEF DESCRIPTION OF THE DRAWINGS

FIG. 1 is a vertical sectional view of a combined parallel plate and coplanar waveguide transmission line structure forming one embodiment of the present invention.

FIG. 2 is a vertical sectional view of a combined parallel plate and slot-line transmission line structure forming a second embodiment of the present invention.

FIGS. 3*a* through 3*d* are vertical sectional views illustrating, in sequence, a practical method of fabricating the combined parallel plate and coplanar waveguide transmission line structure of FIG. 1.

DESCRIPTION OF THE PREFERRED EMBODIMENTS

Referring first to FIG. 1, there is shown at 10 a very small, low loss transmission line that can be incorporated easily as a solid state integrated circuit element and may be readily fabricated in conjunction therewith. The transmission line 10, which may be termed a groove or a trench waveguide line, constitutes a structure which extends uniformly into the paper and consists of a substrate 12 formed of silicon or other semiconductor and having a semi insulating layer 12*b* of low conductivity $\delta_1$ and permittivity $\epsilon_1$ and an active layer 12*a* having a conductivity $\delta_1$ and permittivity $\epsilon_1$. The active layer 12*a* usually has a conductivity much larger than $\delta_1$ ($\epsilon_1$ being the same in both cases). Usually the thickness of the active layer 12*a* is much less than that of semi-insulating ayer 12*b*. Formed within the substrate 12, are a pair of parallel slots 14, 16 which are shown as extending through the active layer 12*a* into the semi insulating region or layer 12*b*. The substrate 12 is metalized as at 26 in the form of a thin Al, Au, Ag, etc., layer on the exposed surface of layer 12*a*. The metalization 26 is of a thickness $t_1$ and also fills into the upper portion of the slots 14 ad 16 to form three metalization transmission line segments 26*a*, 26*b* and 26*c*, from left to right. The slots therefore bear on opposite walls; as at 18, 20 for slot 14; and 22, 24 for slot 16, integral vertical portions of the metalization 26 which portions depend downwardly from the upper surface of layer 12*a* to which metalization 26 is applied.

The structure is completed by either completely or partially filling the slots 14, 16 with a low loss ($\delta_{xo}$) dielectric material of a permittivity $\epsilon_2$ which may be different from $\epsilon_1$. As illustrated, the low loss dielectric material 28 is shown as completely filling the slots 14 and 16 and rising to a level somewhat above the metalization 26 to a thickness $t_2$ above that metalization. The complete height of the groove line element is defined by the width of the metalization W of the groove or grooves, the thickness $t_1$ of the metallization 26 on surface 12*a* of that substrate, and the thickness $t_2$ of the low loss material 28 above the metalization 26. It is important that W penetrates into the semi insulating substrate 12 to ensure that metalization 26*b* is insulated from metalizations 26*a* and 26*c*.

The important dimensions that determine the characteristic impedance of the transmission line 10 are shown in FIG. 1. The direction of the electric fields, E and E′ are shown for the odd-mode of operation. For the even mode, the fields to the right of the center plate 8 are reversed. The fields E associated with region 1 are similar to that of parallel plate transmission lines of width W and those of region 2 are similar to that of a coplanar wave guide structure. These transmission lines are essentially combined in parallel making it possible to attain low $Z_0$ impedance lines (e.g. 50 ohms and less) with reasonable values of separation distances S. These dimensions are consistent with those readily achieved in conventional integrated circuit practice.

Appropriately, the electrical connections to effect the operation and to produce the fields E and E' involve the application of an electrical signal as from source 32 through line 30 to metalization section 26b which source is grounded at 34. In turn, the metalization 26a and 26C are grounded via line 36 and ground connection 37.

Referring next to FIG. 2, a second embodiment of the groove line is shown schematically by the vertical sectional view as at 10'. This case can be considered as a parallel combination of a parallel plate line (region 1) with a slot-line (region 2). Elements having like correspondence to those of the first embodiment, FIG. 1, are given prime numeral designations.

In the embodiment of FIG. 2, the semi-conductor substrate 12', which may be silicon or gallium arsenide, has an active layer 12'a of conductivity $\delta_1$ and permittivity $\epsilon_1$, similar to that of FIG. 1. It is provided with a single slot as at 14' forming opposed vertical slot side walls or surfaces 18', 20'. The upper active layer 12'a has applied thereto, a thin coating of metal such as Al, Au, Ag, etc. in a manner such that unitary portions of the metalization coating or layer 26' extends downwardly within slot 14' penetrating into the semi insulating layer 12'b of the substrate on the opposed sidewalls, 18', 20'. Subsequent to the metalization, a low loss dielectric material 28' is applied to the structure so as to partially fill slot 14' or completely fill the slot and extend as an overlay above metal coating 26' to a level $t_2$ which is in excess of the thickness $t_1$ of the metalization coating 26' itself applied directly to the active layer 12'a or the substrate 12'. The metalization coating 26'a is grounded by ground line 36' and ground point 34'. An electrical signal is applied to the metalization coating 26'b via line 30' through source 32'. Source 32' is grounded at 34', all in accordance with the teachings of the first embodiment, FIG. 1. Two electric fields are produced as at E and E'. Again, the fields E associated with region 1 are similar to those of parallel plate transmission lines and those at E' region 2 are similar to those of a slot line semi insulating structure. The substrate semi-insulating layer 12'b has a low value of conductivity $\delta_1$ and the active layer 12'a has a permittivity $\epsilon_1$ equal to that of layer 12'b while the low loss dielectric material 28' constitutes a dielectric material of permittivity $\epsilon_2$.

A useful variation of the structure shown in FIGS. 1 and 2 is the provision of a ground plane on top of the low loss dielectric material layer 28, 28', above region 2 in each instance. This variation is shown in FIG. 2 in dotted lines as a thin metal strip or metal ground plane 40 covering the upper surface of the low loss dielectric material 28' to which strip 40 a ground connection is made via line 42 and ground point 44. While the internal field pattern may be altered, due to the presence of ground plane 40, satisfactory low loss performance with minimum radiation is obtainable.

There may exist several practical methods of fabricating the structures described in conjunction with FIGS. 1 and 2. An exemplary method of fabrication is illustrated in sequence in FIGS. 3a through 3d inclusive utiizing a semi-conductor substrate, FIG. 3a, 12 formed of silicon, for instance, of a conductivity $\delta_1$ and permittivity $\epsilon_1$ having a semi-insulating layer 12b bearing active layer 12a.

In FIG. 3b, in an initial step, grooves as 14, 16 are etched or ion milled within substrate 12 through the active layer 12a into the semi insulating layer 12b.

Referring next to FIG. 3c, in a second step, metalization is applied to the active layer 12a of the substrate 12 by vapor depositing or sputtering metal at a give oblique angle $\theta$ onto the plate the exposed surface of layer 12a of the substrate 12, which oblique angle $\theta$ causes surface build up on the left side 18 and 22 of slots 14 and 16, respectively.

A third step, which is nearly the same as the second step, FIG. 3c, is a repeat or continuation of that step, but with the angle of vapor deposition or sputtering of the metal being equal to $180°-\theta$. That is, the oblique angle to the opposite side of a vertical center line through the substrate 12, causes deposition of the metalization 26 on the opposite sidewalls 20 and 24 of slots 14, 16, respectively, to complete that metalization as evidenced in FIG. 3d.

Turning next to FIG. 3d, the fourth step in the manufacturing process involves applying a low loss dielectric material 28 or example, in liquid form to substrate 12, from the top downwardly, filling slots 14 and 16 and overflowing the slots to cover the metalization 26 on active layer 12a of substrate 12 to a depth $t_2$ which may be equal to, less than, or more than, the thickness $t_1$ of the metalization 26 applied directly to the top of the substrate 12. This liquid low loss dielectric material 28 is then dried and baked to harden the same by conventional techniques.

Where needed, a further step may be required to selectively remove a portion of the low loss dielectric material layer 28 as by ion milling to make contact to the ground line terminal and completion may be achieved by the further removal of unnecessary support structures, if any.

The semi-conductor substrate 12 may comprise, in addition to silicon, gallium arsenide, aluminum gallium arsenide or indium phosphide. The low loss dielectric material 28 may comprise a polyimide, silicon dioxide or polysilicon. In addition to aluminium, silver or gold, the metalizing as at 38 and 26 may be of titanium or tungsten or gold/germanium/nickel alloy. Chemical etching of these materials are readily achieved using etchants well known to the semiconductor art. Such techniques, however, are, in themselves, conventional in the creation of semi-conductor integrated circuit elements.

It should be further appreciated that the active layer 12a, 12'a, may be of varying thickness and may be allowed to equal zero, i.e. elimination of the same without departing from the scope of the invention. Under those conditions, the combined parallel plate and slot line transmission line structure may be fabricated on a semi-insulating layer as the substrate. Additionally, the back side of the wafer, which wafer is semi-insulating, may function as the substrate for a back side transmission line fabricated in the same manner as the front side transmission line structure evidenced in FIGS. 1 and 2.

While the invention has been particularly shown and described with reference to preferred embodiments thereof, it will be understood by those skilled in the art that the foregoing and other changes in form and details may be made therein without departing from the spirit and scope of the invention.

I claim:

1. A transmission line structure comprising:

a semi-conductor substrate including a semi insulating layer of low conductivity underlying an active layer of different conductivity and permittivity, a slot extending through said substrate active layer and partially through said semi insulating layer, a thin metalization coating across the exposed surface of said substrate active layer and extending into said slot along opposed sides thereof to a depth beyond said active layer and forming a gap therein across said slot, and a low loss dielectric material of second permittivity at least partially filling said slot and spanning between said metalization coatings on opposite sides of said slot to thereby form a combined parallel plate and slot line transmission line.

2. The transmission line structure as claimed in claim 1, further comprising a second slot extending through said substrate active layer and partially through said semi insulating layer, and extending parallel to said first slot, and wherein thin metalization coating extends across the exposed surface of said substrate active layer and extends into both said slots along opposed sides thereof to a depth beyond the active layer to form gaps therein across both slots and the low loss dielectrical material of second permittivity, at least partially fills both slots and spans between the metalization coatings on opposite sides of both said slots, thereby defining a combined parallel plate and and coplanar waveguide structure.

3. The transmission line structure as claimed in claim 1, wherein said low loss dielectric material of second permittivity completely fills said slot and extends across and over the metalization coating on said substrate.

4. The transmission line structure as claimed in claim 2, wherein said low loss dielectric material of second permittivity completely fills said slots and extends across and over the metalization coating on said substrate.

5. The transmission line structure as claimed in claim 3, further comprising a thin metalization coating overlying said low loss dielectric material covering the metalization coating on said active layer surface to provide a ground plane therefor.

6. The transmission line structure as claimed in claim 4, further comprising a thin metalization coating overlying said low loss dielectric material covering the metalization coating on said active layer surface to provide a ground plane therefor.

* * * * *